US012779304B2

(12) United States Patent
King et al.

(10) Patent No.: US 12,779,304 B2
(45) Date of Patent: Nov. 3, 2026

(54) STRIKE AND LOCATION DEVICE FOR BASEBALL AND SOFTBALL TRAINING AND EVALUATION

(71) Applicants: George R. King, Richmond, TX (US); George Andrew King, Katy, TX (US); Santos D. Ortiz, Magnolia, TX (US)

(72) Inventors: George R. King, Richmond, TX (US); George Andrew King, Katy, TX (US); Santos D. Ortiz, Magnolia, TX (US)

(73) Assignee: DIAMOND BOUND SPORTS, LLC., Richmond, TX (US)

( * ) Notice: Subject to any disclaimer, the term of this patent is extended or adjusted under 35 U.S.C. 154(b) by 314 days.

(21) Appl. No.: 18/351,938

(22) Filed: Jul. 13, 2023

(65) Prior Publication Data

US 2024/0017145 A1 Jan. 18, 2024

Related U.S. Application Data

(60) Provisional application No. 63/368,579, filed on Jul. 15, 2022.

(51) Int. Cl.
*A63B 69/00* (2006.01)
*A63B 71/06* (2006.01)

(52) U.S. Cl.
CPC ..... *A63B 69/0002* (2013.01); *A63B 71/0622* (2013.01); *A63B 2069/0008* (2013.01); *A63B 2214/00* (2020.08); *A63B 2220/13* (2013.01); *A63B 2220/20* (2013.01); *A63B 2220/62* (2013.01); *A63B 2220/803* (2013.01); *A63B 2220/833* (2013.01); *A63B 2225/74* (2020.08)

(58) Field of Classification Search
CPC ..... A63B 69/0002; A63B 71/0622; A63B 2069/0008; A63B 2214/00; A63B 2220/13; A63B 2220/20; A63B 2220/62; A63B 2220/803; A63B 2220/833; A63B 2225/74; A63B 2102/18; A63B 2102/182; A63B 2220/40; A63B 2220/53
USPC ..... 473/479, 45–457, 476; 482/83, 84
See application file for complete search history.

(56) References Cited

U.S. PATENT DOCUMENTS 2,040,228 A * 5/1936 Whiteley ..... A63B 63/00 273/455
2,443,131 A * 6/1948 Fessler ..... A63B 69/0002 434/247
4,461,477 A * 7/1984 Stewart ..... A63B 69/0002 473/409
4,708,343 A * 11/1987 D'Ambrosio ..... A63B 69/0002 473/457
5,071,122 A * 12/1991 Messina ..... A63B 69/0053 473/429
5,711,726 A * 1/1998 Powers ..... A63B 69/0002 473/453

(Continued)

*Primary Examiner* — Nini F Legesse
(74) *Attorney, Agent, or Firm* — Smith IP Services, P.C.

(57) ABSTRACT

A stimulus and sensor device can include a body comprising a resilient material, the body being configured to be struck by a bat, multiple light sources longitudinally spaced apart along the body, and multiple motion sensors longitudinally spaced apart along the body. A method of evaluating batting performance can include activating one of a series of light sources spaced apart along a body, and measuring motion of the body due to being struck after the activating step.

24 Claims, 7 Drawing Sheets

(56) References Cited

U.S. PATENT DOCUMENTS

| | | | | |
|---|---|---|---|---|
| 6,110,079 | A * | 8/2000 | Luedke | A63B 69/22 446/268 |
| 7,134,976 | B1 * | 11/2006 | Smith | A63B 63/003 273/400 |
| 8,602,949 | B2 * | 12/2013 | Pelletter | G06F 3/011 482/84 |
| 8,974,324 | B2 | 3/2015 | Chen | |
| 8,992,348 | B2 | 3/2015 | Meier et al. | |
| 9,782,652 | B2 * | 10/2017 | Williamson | A63B 69/305 |
| 9,884,238 | B2 * | 2/2018 | Tsai | G01L 5/0052 |
| 9,943,742 | B2 * | 4/2018 | Burt, Jr. | A63B 69/322 |
| 10,987,561 | B1 * | 4/2021 | Meredith | A63B 69/0002 |
| 11,266,894 | B2 * | 3/2022 | Morin | A63B 71/0622 |
| 11,654,340 | B2 | 5/2023 | Meredith | |
| 2002/0042312 | A1 * | 4/2002 | Decloux | A63B 69/0053 473/476 |
| 2003/0216228 | A1 * | 11/2003 | Rast | A63B 47/021 482/84 |
| 2005/0085321 | A1 * | 4/2005 | Diveglio | A63B 69/0002 473/453 |
| 2008/0125293 | A1 * | 5/2008 | Ng | A63B 69/32 482/84 |
| 2015/0238834 | A1 | 8/2015 | Esper | |
| 2016/0051877 | A1 | 2/2016 | Sieber | |
| 2016/0067575 | A1 | 3/2016 | Choate et al. | |
| 2017/0036087 | A1 * | 2/2017 | Codrington | B32B 9/025 |
| 2022/0023732 | A1 * | 1/2022 | Karas | A63B 63/004 |
| 2023/0123369 | A1 | 4/2023 | Miller et al. | |

* cited by examiner

STRIKE AND LOCATION DEVICE FOR BASEBALL AND SOFTBALL TRAINING AND EVALUATION

BACKGROUND

This disclosure relates generally to sports equipment and associated methods and, in an example described below, more particularly provides a strike and location device for baseball and softball training and evaluation.

In baseball and softball the ability to apply a bat to a particular location in the fastest amount of time determines an individual's capability at being successful in the batting phase of the game. A batter needs to be able to quickly determine where to strike, and to strike the determined location accurately.

It will therefore be readily appreciated that improvements are continually needed in the art of batter performance evaluation. The evaluation may include determining the batter's reaction time and batting accuracy. The evaluation may be for training, competition, entertainment or other purposes.

DETAILED DESCRIPTION

Figure 1:
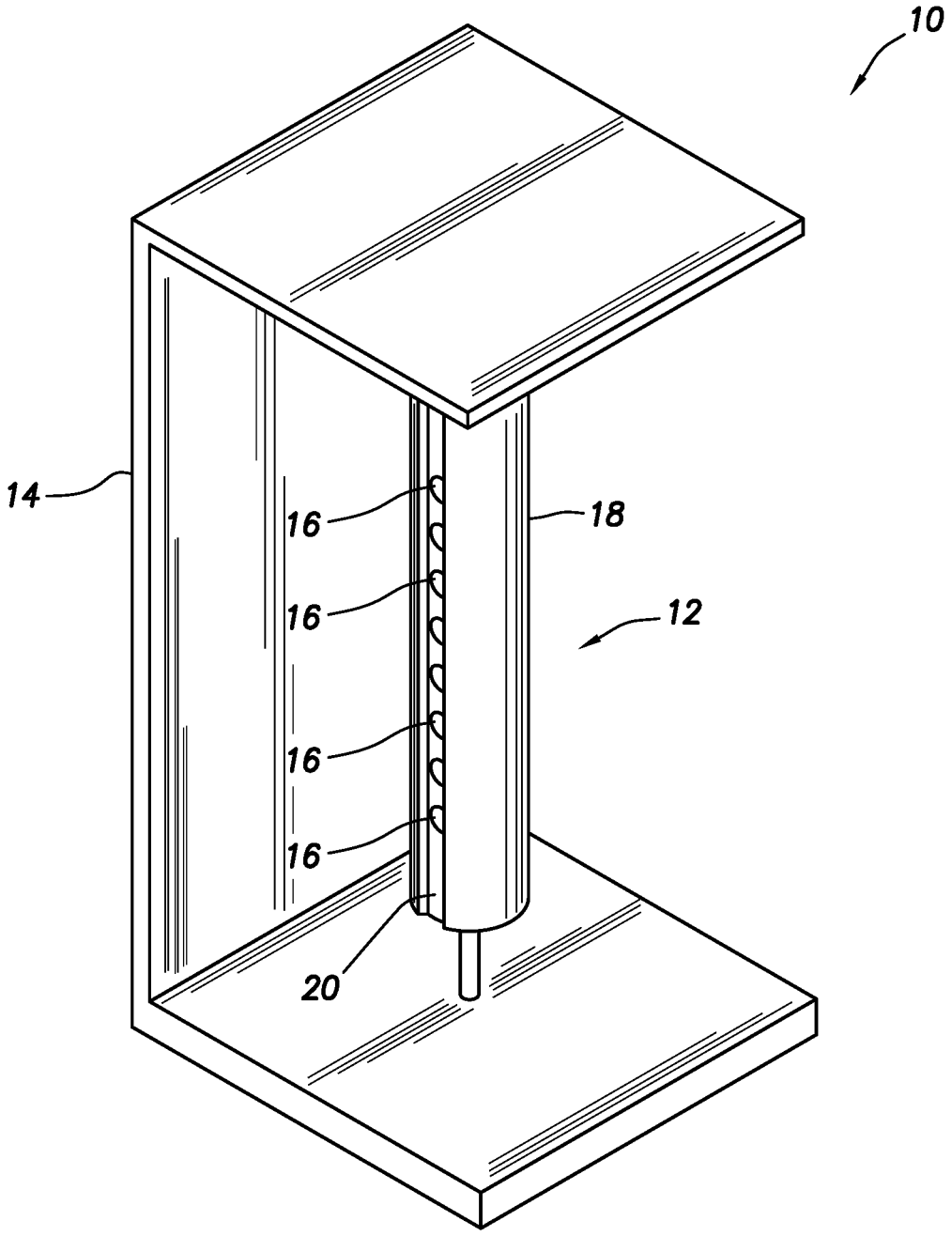
FIG. 1 is a representative perspective view of an example of a strike and location detection system and associated method which can embody principles of this disclosure.

Representatively illustrated in the accompanying FIGS. 1-7 is a strike and location detection system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

The ability to measure and evaluate an individual's capabilities of achieving batting proficiency in a quantitative fashion is not currently available. For example, a batter's reaction time and batting accuracy are not quantitatively measured currently.

A device 12 depicted in the figures will apply a timing measurement of a light source coupled with an accelerometer, packaged in a shock absorbing, and characterized material 48 (see FIG. 3) to achieve this evaluation. The data from this system 10 can be applied to all ages and skill levels of individuals to be used not only as an evaluation tool but also a training tool. In some examples, the system can be used for entertainment purposes (such as, in an arcade), or for competitive purposes with one or more competing batters.

In one example, this device 12 comprises a calibrated shock absorbing material in the form of a cylinder. This cylinder is constructed of a mechanically characterized material so that a shock transfer can be determined as it passes through the cylinder.

The cylinder has bore locations at vertical increments that are open to an internal portion of the cylinder at a known radius. Inside the internal radius of the cylinder at each vertical location a light source is coupled to a motion sensor (such as an accelerometer or a displacement transducer). Increments of distance between the vertical locations determine a resolution of measurement.

The motion sensors can be multi-axis capable accelerometers. The greater the number of accelerometer locations vertically, the higher the resolution of the evaluation.

In one example, two primary determinations or evaluations are provided by the device 12. One is a reaction time of a batter between the light source being activated to a bat striking the device 12. When one of the light sources is activated, the batter will try to strike the location where the light source is illuminated. This will result in a measurable time difference from when the light source is activated to when the motion sensor detects the strike. This will provide a reaction time.

Another determination or evaluation provided by the device 12 in one example is a batting accuracy. This determination can utilize the measurements of multiple motion sensors distributed vertically on the device 12. The motion sensor measurements can enable determination of the location of strike, which can be compared to the location of the activated light source.

Referring now to FIG. 1, a perspective view of the system 10 is representatively illustrated. In this view, rear and left sides of the device 12 are visible. The device 12 is suspended and maintained in a vertical orientation by a frame 14.

In the FIG. 1 example, eight vertically spaced apart recesses 16 are formed in a body 18 of the device 12. Other numbers of recesses may be used in other examples. The recesses 16 are equally spaced apart, but in other examples, vertical distances between the recesses may vary.

As depicted in FIG. 1, the recesses 16 extend inwardly from a vertical slot formed in the body 18. The slot 20 provides space for wiring between sensors, lights and a control system, as described more fully below. In other examples the slot 20 may not be used, or the wiring may be otherwise accommodated in the body 18.

Figure 2:
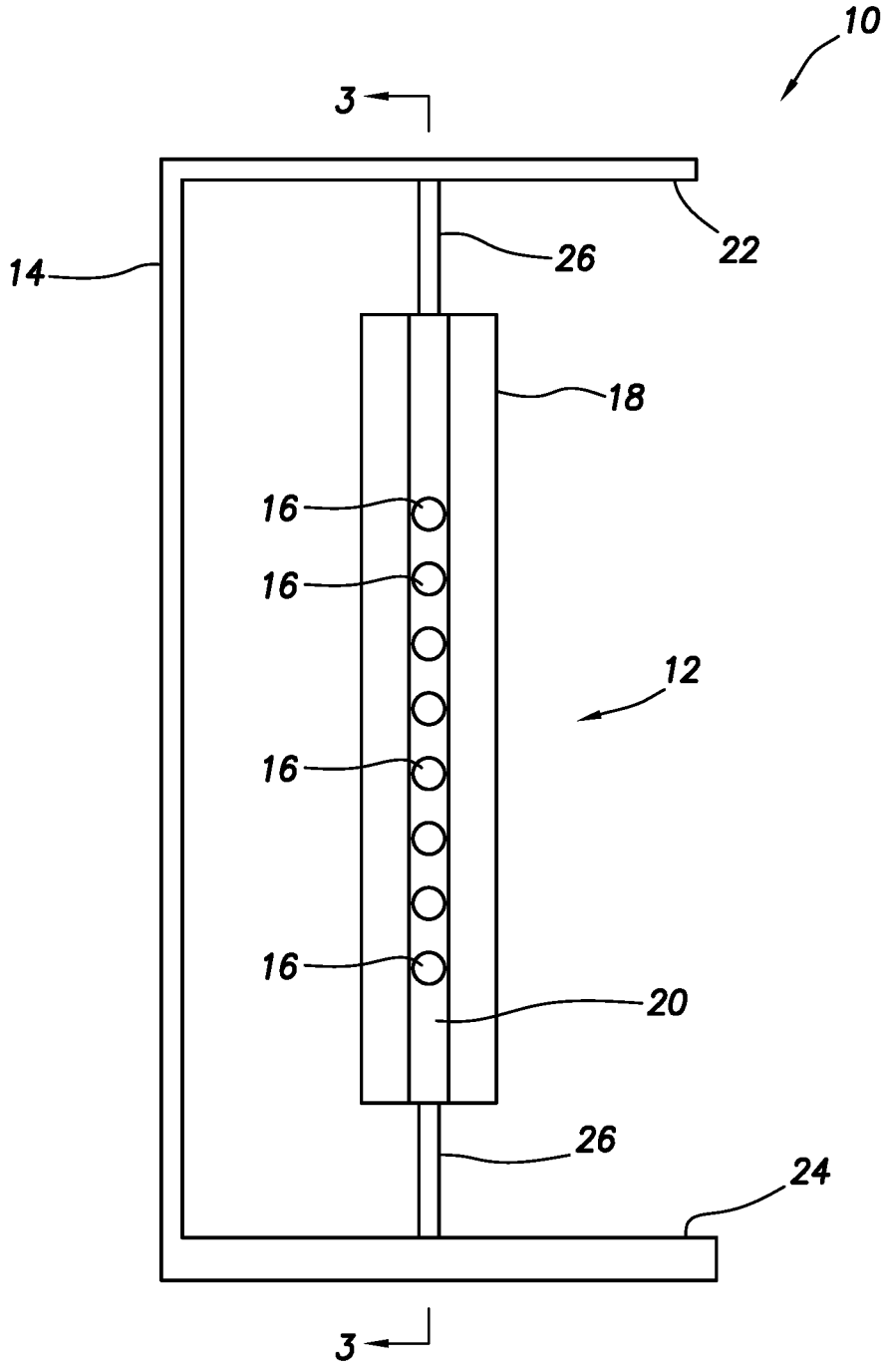
FIG. 2 is a representative rear view of the strike and location detection system.

Referring additionally now to FIG. 2, a rear view of the system 10 is representatively illustrated. In this view it may be seen that the body 18 is suspended between upper and lower sections 22, 24 of the frame 14 with supports 26. The supports 26 may be rigid, or may be flexible to permit some lateral movement of the body 18 between the frame upper and lower sections 22, 24.

In this example, the body 18 is made of a resilient or elastomeric material 48, such as, foam rubber. The material 48 is preferably "characterized," in that the manner in which shock or pressure waves are transmitted through the material is known. For example, a person of ordinary skill in the art can readily determine how much time it will take for a bat strike on a surface of the body 18 to be transmitted to a motion sensor positioned in one of the recesses 16.

Figure 3:
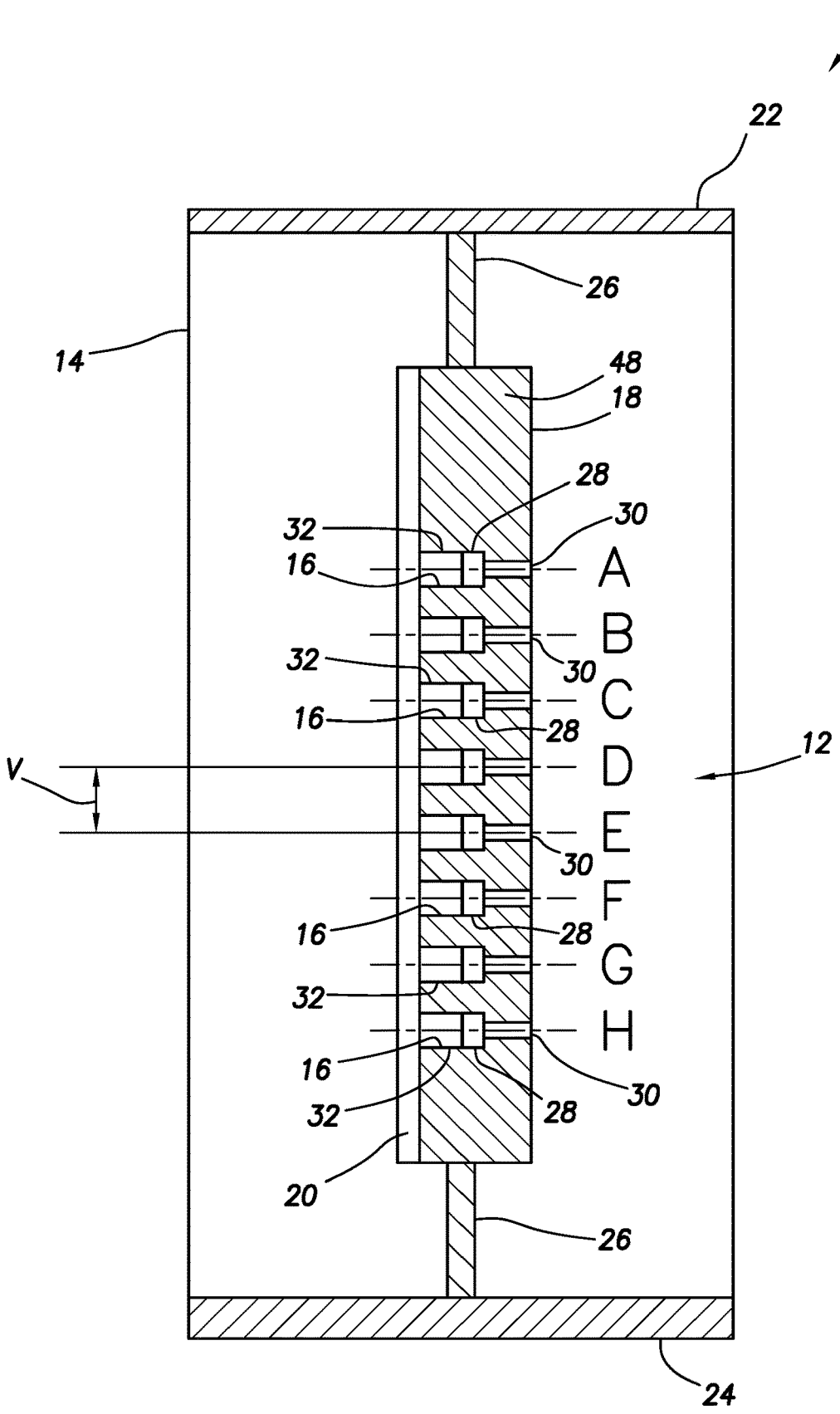
FIG. 3 is a representative cross-sectional view of the strike and location detection system, taken along line 3-3 of FIG. 2.

Referring additionally now to FIG. 3, a cross-sectional view of the device 12, taken along line 3-3 of FIG. 2 is representatively illustrated. In this view, it may be seen that a light source 28 is received in each of the recesses 16. Light from the light sources 28 when activated is visible through multiple ports 30 formed in a front side of the body 18.

In some examples, the light sources 28 may comprise light emitting diodes. Preferably, the light generated by the light sources 28 is clearly visible to a batter viewing the front side of the device 12, and a difference in time between supplying electrical power to a light source and the light source generating the light is minimal or insignificant.

In the FIG. 3 example, motion sensors 32 are also received in the recesses 16. Thus, each recess 16 has therein a light source 28 and a corresponding motion sensor 32. The recesses 16, light sources 28 and motion sensors 32 are equally spaced apart, with a vertical distance V between adjacent pairs.

The motion sensors 32 may comprise any type of sensors capable of detecting movement of the body 18 upon being struck with a bat. In some examples, the motion sensors 32 comprise accelerometers (such as, three-axis capable accelerometers), linear variable displacement transducers, proximity sensors or limit switches.

For convenience, each set of light source 28 and motion sensor 32 is designated in FIG. 3 with a letter. The letters begin with "A" at an uppermost location of a light source 28 and a motion sensor 32, and end with "H" at a lowermost location of a light source and a motion sensor.

Figure 4:
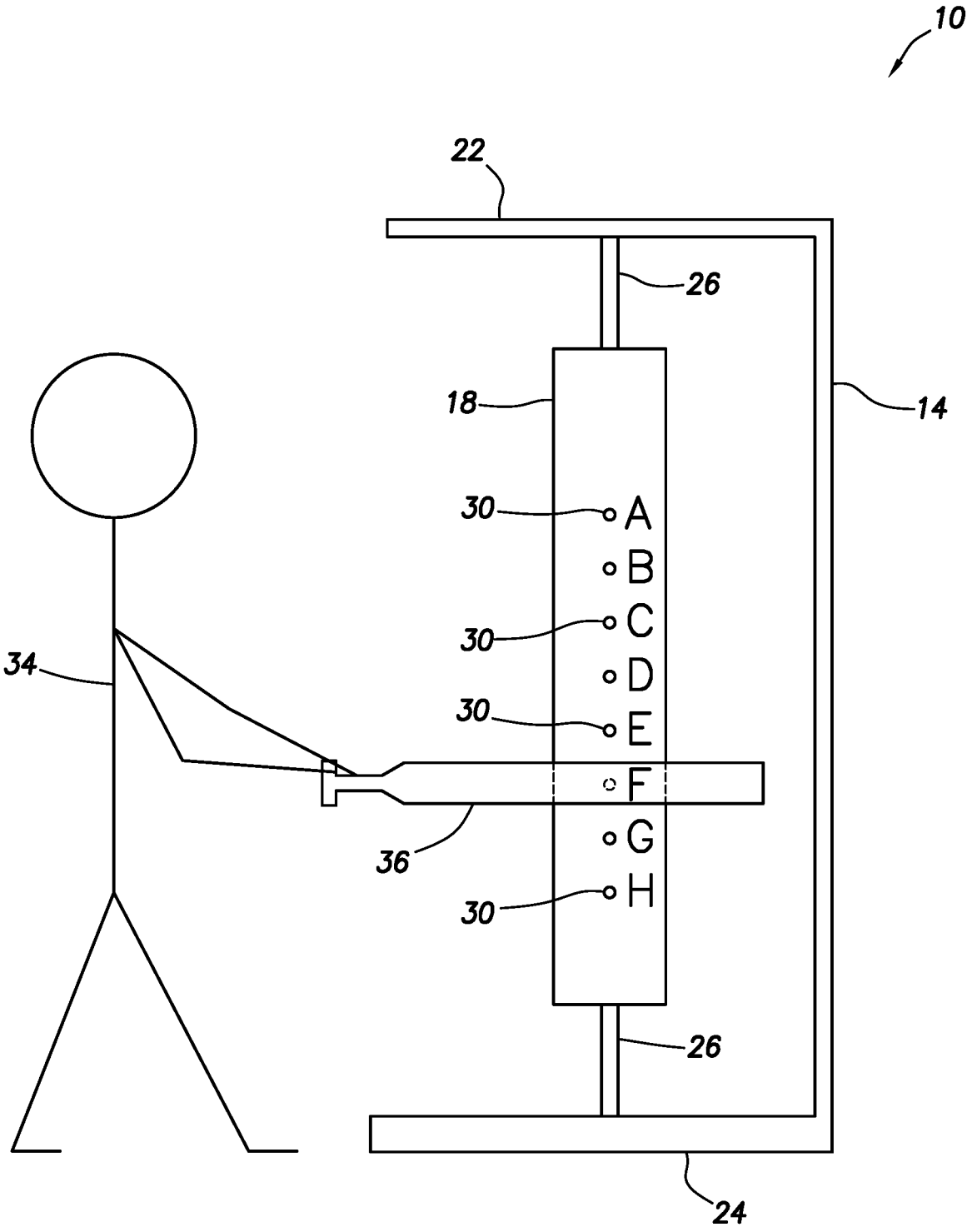
FIG. 4 is a representative front view of the strike and location detection system, with a person striking a stimulus and sensor device of the system.

Referring additionally now to FIG. 4, a front view of the device 12 is representatively illustrated. A batter 34 is depicted striking the body 18 with a bat 36 at a location "F."

In one method, the light source 28 at the location "F" is activated. The batter 34 sees the light produced by the light source 28 via the port 30 at the "F" location. The batter 34 then attempts to strike the body 18 with the bat 36 at the "F" location.

The batter's 34 reaction time can be expressed as a difference in time between when the light source 28 was activated and when the batter struck the body 18 with the bat 36. A control system (described more fully below, see FIG. 7) can be used to activate the light source 28, record when the light source is activated, record when the motion sensor 32 detects movement of the body 18, and calculate the reaction time. The calculation of the reaction time can take into account the time needed to transmit shock or pressure waves through the material 48 of the body 18.

The batter's 34 batting accuracy can be expressed as a difference between a vertical location of the activated light source 28 and a vertical location at which the body 18 is struck with the bat 36. For example, if the light source 28 at the "F" location is activated, and then the body 18 is struck with the bat 36 at the same "F" location, the batter's accuracy is high. If instead the body 18 is struck with the bat 36 at another location, the accuracy diminishes as a vertical distance between the "F" location and the location at which the body is struck increases.

The control system can be used to activate the light source 28, record the location at which the light source 28 is activated, record measurements taken by the motion sensors 32, determine a location at which the body 18 is struck based on the motion sensor measurements, and determine a vertical distance between the activated light source and the vertical position at which the body was struck. The control system can display or otherwise output the reaction time and batting accuracy results to a user.

Figure 5:
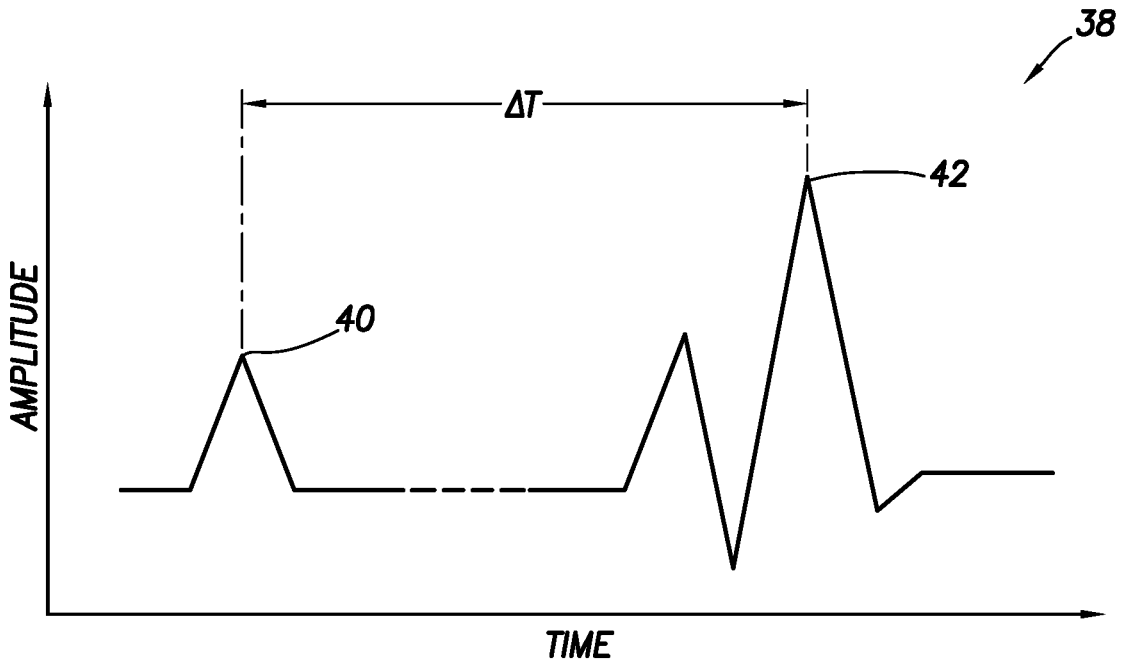
FIG. 5 is a representative graph of amplitude vs. time for a light stimulus and a motion sensor output.

Referring additionally now to FIG. 5, an example graph 38 of amplitude vs. time is representatively illustrated. The graph 38 demonstrates how reaction time can be determined for a batter 34 using the system 10 and method described herein.

As depicted in FIG. 5, an initial amplitude peak 40 is due to the light source 28 being activated. The graph 38 may represent voltage or current being supplied to the light source 28.

Another amplitude peak 42 is due to the body 18 being struck with the bat 36. The graph 38 may represent an output (e.g., current or voltage) of a motion sensor 32 that detects movement of the body 18 due to being struck. The timing of the amplitude peak 42 may be adjusted to account for the time required for a shock or pressure wave to be transmitted through the material 48 of the body 18.

A difference in time $\Delta T$ between the amplitude peaks 40, 42 is the batter's 34 reaction time. The control system can display or otherwise output the reaction time to the batter 34 or another user.

Figure 6:
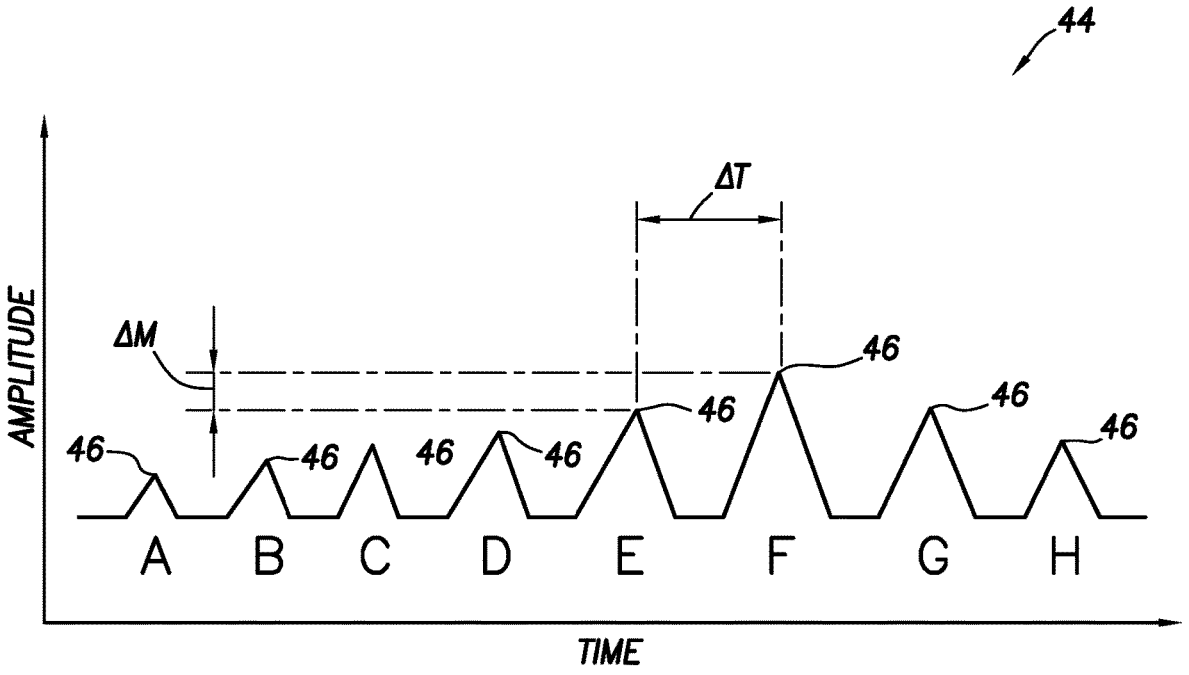
FIG. 6 is a representative graph of amplitude vs. time for outputs of multiple motion sensors.

Referring additionally now to FIG. 6, another example graph 44 of amplitude vs. time is representatively illustrated. In this example, the outputs of each of the motion sensors 32 at the respective locations "A-F" are depicted.

At each of the locations, there is an amplitude peak 46 in the output of the corresponding motion sensor 32. By evaluating the timing of each of the various amplitude peaks 46, the maximum amplitude of each peak, and differences in timing ($\Delta T$) and amplitude ($\Delta M$) between the locations, the vertical location at which the body 18 was struck with the bat 36 can be readily determined by the control system.

Figure 7:
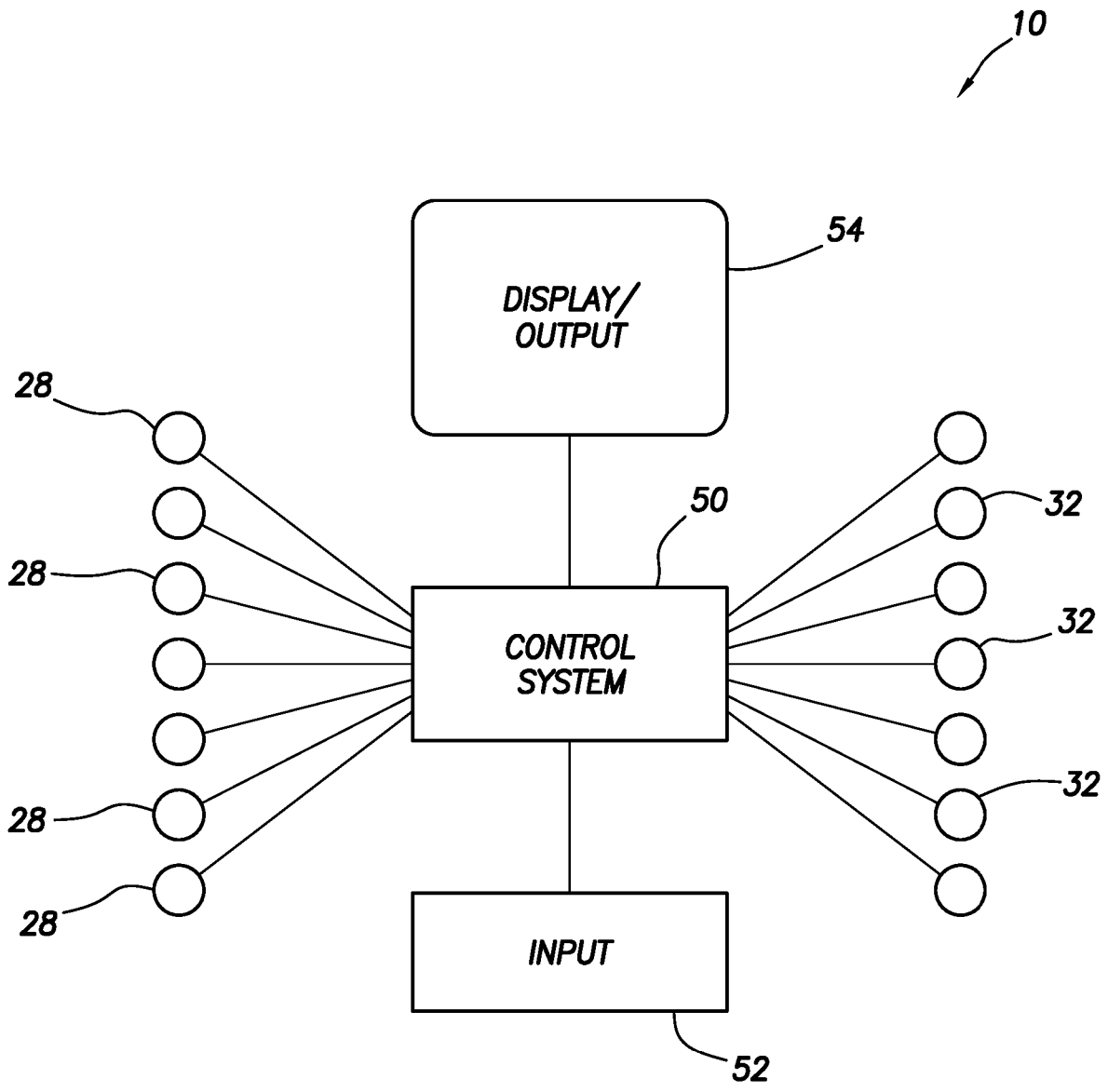
FIG. 7 is a representative schematic of a control system as used in the system.

Referring additionally now to FIG. 7, a schematic of the control system 50 as used with the system 10 and method is representatively illustrated. As depicted in FIG. 7, the control system 50 is used to activate the light sources 28 and to receive the outputs of the motion sensors 32. The control system 50 can also receive inputs 52 from a batter 34 or other user, and provide a display or other output 54.

The control system 50 can comprise one or more processors, a programmable logic controller, and volatile and non-volatile memory. Software, instructions and databases may be stored in the memory. Specifically, the control system 50 can include routines for determining reaction time and batting accuracy, based on recorded activations of the light sources 28, and recorded motion measurements output by the motion sensors 32.

The inputs 52 may include identification of the batter 34 or other user, desired parameters (e.g., speed, position, etc.) for the light source 28 activation, and what type of activity is desired (training, evaluation, entertainment, competition, etc.). The inputs 52 may be provided using a joystick, keyboard, touch pad, mouse or other device.

The output 54 may include the reaction time and the batting accuracy as determined by the control system 50. The output 54 may be provided using a display, a printer, a speaker or other device.

In the system 10 and method, the control system 50 selects which of the light sources 28 is to be activated, or which light sources are to be activated in what order. For example, the control system 50 may select one of the light sources 28 at random, and then select another one of the light sources at random, etc. Alternatively, the control system 50 could select a pattern or sequence of activation, based for example on the batter's 34 age, experience or past performance. As another alternative, the user could select the pattern or sequence via the input 52.

It may now be fully appreciated that the above disclosure provides significant advancements to the art of batter evaluation. This evaluation may be used for training, competition, entertainment or other purposes.

A strike and location detection system 10 and method are described above, in which a device 12 comprising a series of spaced apart motion sensors 32 is used to detect a strike and a location of the strike along the device.

A strike and location detection system 10 and method are described above, in which a device 12 comprising a series of spaced apart light sources 28 is used to prompt a batter 34 to strike the device at an indicated location along the device. A reaction time from illumination of a light source 28 to a bat 36 striking the device 12 is determined. A location of a strike along the device 12 is determined by comparing the outputs of a series of motion sensors 32 distributed along the device.

The above disclosure provides to the art a stimulus and sensor device 12. In one example, the device 12 can comprise: a body 18 comprising a resilient material 48, multiple light sources 28 longitudinally spaced apart along the body 18; and multiple motion sensors 32 longitudinally spaced apart along the body 18. The body 18 is configured to be struck by a bat 36.

The light sources 28 and the motion sensors 32 may be equally spaced apart along the body 18. The light sources 28 and the motion sensors 32 may be recessed into the body 18.

Each of the light sources 28 may be positioned proximate a respective one of the motion sensors 32. Each of the motion sensors 32 may comprise an accelerometer.

The device 12 may include a frame 14 configured to position the body 18 in a vertical orientation, so that the light sources 28 are distributed vertically along the body 18.

The device 12 may include a control system 50 configured to activate one of the light sources 28, and to measure a difference in time between the activation of the light source 28 and detection of motion by one of the motion sensors 32. The light source 28 to be activated may be selected at random.

The device 12 may include a control system 50 configured to activate one of the light sources 28, and to measure a difference in location between the activated light source and a position at which the body 18 is struck. The control system 50 may be configured to determine the position at which the body 18 is struck based on detection of motion by the motion sensors 32.

A method of evaluating batting performance is also provided to the art by the above disclosure. In one example, the method comprises: activating one of a series of light sources 28 vertically spaced apart along a body 18; and measuring motion of the body 18 due to being struck after the activating step.

The measuring motion step may be performed by a series of motion sensors 32 vertically spaced apart along the body 18. Each of the motion sensors 32 may comprise an accelerometer.

The measuring step may include measuring motion of the body 18 at each of the motion sensors 32. The method may include determining a difference in time between the activating step and the measuring step. The method may include determining a distance between the activated light source 28 and a location at which the body 18 is struck after the activating step.

The method may include determining the location the body 18 is struck based on measurements taken by multiple spaced apart motion sensors 32. The method may include vertically spacing apart the motion sensors 32 along the body 18.

The method may include vertically spacing apart the light sources 28 along the body 18. The light sources 28 may be equally spaced apart.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A stimulus and sensor system, comprising:

a body comprising a resilient material;

a frame, in which the body is suspended between upper and lower horizontal sections of the frame;

a bat with which a person strikes the body;

multiple light sources longitudinally spaced apart along the body, in which a selected light source indicates a target location on the body to be struck by the bat; and multiple motion sensors longitudinally spaced apart along the body, in which the motion sensors detect movement of the body when the body is struck by the bat.

2. The stimulus and sensor system of claim 1, in which the light sources and the motion sensors are equally spaced apart along the body.

3. The stimulus and sensor system of claim 1, in which the light sources and the motion sensors are recessed into the body.

4. The stimulus and sensor system of claim 1, in which each of the light sources is positioned proximate a respective one of the motion sensors.

5. The stimulus and sensor system of claim 1, in which each of the motion sensors comprises an accelerometer.

6. The stimulus and sensor system of claim 1, in which the frame is configured to position the body in a vertical orientation, whereby the light sources are distributed vertically along the body.

7. The stimulus and sensor system of claim 1, further comprising a control system configured to activate one of the light sources, and to measure a difference in time between the activation of the one of the light sources and detection of motion by one of the motion sensors.

8. The stimulus and sensor system of claim 7, in which the one of the light sources is selected at random.

9. The stimulus and sensor system of claim 1, further comprising a control system configured to activate one of the light sources, and to measure a difference in location between the activated of the one of the light sources and a position at which the body is struck.

10. The stimulus and sensor system of claim 9, in which the control system is configured to determine the position at which the body is struck based on detection of motion by the motion sensors.

11. The stimulus and sensor system of claim 1, in which the body is connected to the upper and lower horizontal sections of the frame by upper and lower vertical supports, respectively.

12. The stimulus and sensor system of claim 11, in which at least one of the supports is flexible.

13. A method of evaluating batting performance, the method comprising:

suspending a body between upper and lower horizontal sections of a frame;

activating one of a series of light sources spaced apart along the body; and measuring motion of the body due to being struck by a bat after the activating.

14. The method of claim 13, in which the measuring motion is performed by a series of motion sensors vertically spaced apart along the body.

15. The method of claim 14, in which each of the motion sensors comprises an accelerometer.

16. The method of claim 14, in which the measuring comprises measuring motion of the body at each of the motion sensors.

17. The method of claim 13, further comprising determining a difference in time between the activating and the measuring.

18. The method of claim 13, further comprising determining a distance between the one of the series of light sources and a location at which the body is struck after the activating.

19. The method of claim 18, further comprising determining the location the body is struck based on measurements taken by multiple spaced apart motion sensors.

20. The method of claim 19, further comprising vertically spacing apart the motion sensors along the body.

21. The method of claim 13, further comprising vertically spacing the light sources along the body.

22. The method of claim 21, in which the vertically spacing comprises equally spacing apart the light sources along the body.

23. The method of claim 13, in which the body is connected to the upper and lower horizontal sections of the frame by upper and lower vertical supports, respectively.

24. The method of claim 23, in which at least one of the supports is flexible.

* * * * *